United States Patent [19]

Blackmon

[11] 4,048,824

[45] Sept. 20, 1977

[54] KEY CASE

[75] Inventor: Macy B. Blackmon, Indianapolis, Ind.

[73] Assignee: The Raymond Lee Organization, Inc., New York, N.Y. ; a part interest

[21] Appl. No.: 694,085

[22] Filed: June 9, 1976

[51] Int. Cl.[2] ..... A47G 29/10
[52] U.S. Cl. ..... 70/456 R
[58] Field of Search ..... 70/456–459; 24/3 K; 150/40; 63/1, 19

[56] References Cited

U.S. PATENT DOCUMENTS

| | | | |
|---|---|---|---|
| 689,872 | 12/1901 | Griscom | 24/3 K |
| 1,451,802 | 4/1923 | Andrews | 70/456 R |
| 1,704,137 | 3/1929 | Miller | 24/3 K |
| 1,726,569 | 9/1929 | Kasting | 150/40 |
| 2,871,902 | 2/1959 | Weil | 150/40 |
| 3,813,907 | 6/1974 | Jones | 70/456 R |

*Primary Examiner*—Robert L. Wolfe
*Attorney, Agent, or Firm*—Daniel Jay Tick

[57] ABSTRACT

A house key is removably mounted on a key fastener in an ornamental housing worn on a neck chain by a person.

1 Claim, 5 Drawing Figures

KEY CASE

BACKGROUND OF THE INVENTION

The present invention relates to a key case.

Objects of the invention are to provide a key case of simple structure, which is inexpensive in manufacture, used with facility and convenience, and easily carried on the person of the user so that he or she may always retain a member key such as, for example, a house key, and therby avoid locking himself or herself out.

BRIEF DESCRIPTION OF THE DRAWINGS

In order that the invention may be readily carried into effect, it will now be described with reference to the accompanying drawings, wherein.

DETAILED DESCRIPTION OF THE INVENTION

The key case of the invention comprises an ornamental openable housing 1 large enough in dimensions to house a house key.

Figure 4:
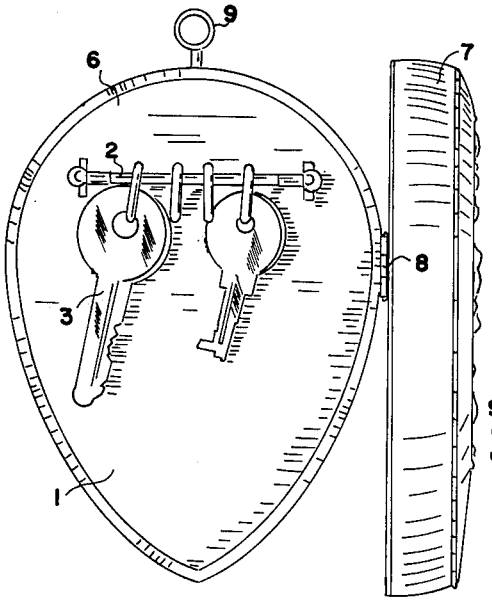
FIG. 4 is a view, on an enlarged scale, of the embodiment of FIG. 1, in open condition.

A key fastening device 2 of any suitable known type is provided in the housing 1, as shown in FIG. 4, for removably mounting a house key 3 in the housing.

Figure 1:
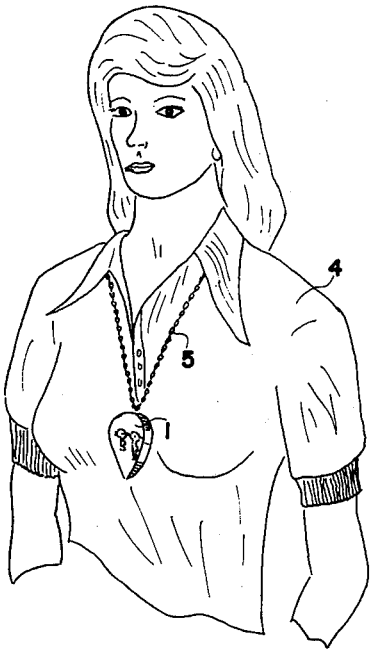
FIG. 1 is a view of an embodiment of the key case of the invention, in open condition, worn on the person of a user.

A housing fastening device removably supports the housing 1 on a person 4 (FIG. 1). The housing fastening device may comprise any device for removably affixing the housing 1 to an article of clothing or to the body of the user. In a preferred embodiment of the invention, the housing fastening device comprises a neck chain 5 (FIGS. 1 and 2) for suspending the housing 1 from the neck of the person 4.

The housing 1 may comprise any suitable openable housing of suitable dimensions such as, for example, as shown in the FIGS., two halfs housings 6 and 7 (FIGS. 4 and 5) hingedly affixed to each other by any suitable hinge device such as, for example, a hinge 8 (FIG. 4).

Figure 2:
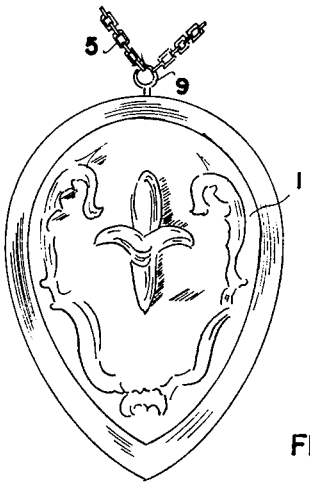
FIG. 2 is a view, on an enlarged scale, of the embodiment of FIG. 1, in closed condition.
Figure 3:
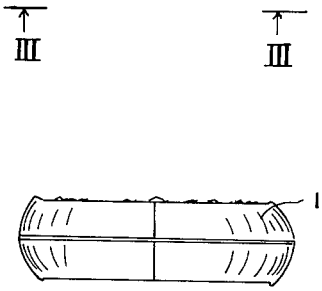
FIG. 3 is a view, taken along the lines III—III, of FIG. 2.
Figure 5:
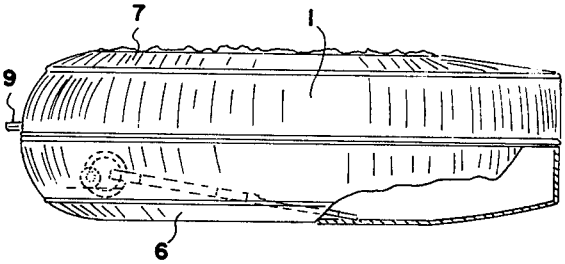
FIG. 5 is a view, partly cutaway and partly in section, of the embodiment of FIG. 4 in closed condition.

The neck chain 5 is affixed to the housing 1 by any suitably means such as, for example, a loop 9 (FIGS. 2, 4 and 5).

While the invention has been described by means of a specific example and in a specific embodiment, I do not wish to be limited thereto, for obvious modifications will occur to those skilled in the art without departing from the spirit and scope of the invention.

I claim:

1. A neckcase, comprising an ornamental openable housing large enough in dimensions to house a key, said housing comprising a pair of equal generally heart-shaped halves hingedly affixed to each other;

key fastening means in the housing for removably mounting a house key in the housing; and housing fastening means for removably supporting said housing on a person, said housing fastening means comprising an eyelet affixed to one of the halves of the housing and a neck chain passing through the eyelet for suspending the housing from the neck of a person.

* * * * *